US005367220A

United States Patent [19]

Stadler et al.

[11] Patent Number: 5,367,220

[45] Date of Patent: Nov. 22, 1994

[54] ELECTRIC LAMP WITH A HOLDING FRAME FOR A LAMP FILAMENT

[75] Inventors: Karl Stadler, Adelschlag; Roland Stark, Wellheim; Ruediger Klam, Eichstaett, all of Germany

[73] Assignee: Patent-Treuhand-Gesellschaft für elektrische Glühlampen mbH, Munich, Germany

[21] Appl. No.: 887,091

[22] Filed: May 22, 1992

Related U.S. Application Data

[63] Continuation-in-part of Ser. No. 661,593, Feb. 26, 1991, Pat. No. 5,146,134.

[30] Foreign Application Priority Data

| | | | |
|---|---|---|---|
| Mar. 15, 1990 | [DE] | Germany | 4008334 |
| Mar. 15, 1990 | [DE] | Germany | 4008337 |
| Sep. 24, 1990 | [DE] | Germany | 9013457[U] |
| Mar. 4, 1991 | [DE] | Germany | 4106851 |

[51] Int. Cl.[5] ..... H01K 1/24

[52] U.S. Cl. ..... 313/578; 313/273; 313/274; 313/278; 313/279

[58] Field of Search ..... 313/271, 272, 273, 274, 313/278, 279, 578, 579; 314/134

[56] References Cited

U.S. PATENT DOCUMENTS

| | | | |
|---|---|---|---|
| 3,237,045 | 2/1966 | Volzer et al. | 313/279 |
| 3,375,393 | 3/1968 | Morgan | 313/278 X |
| 3,696,265 | 10/1972 | Martin et al. | 313/579 |
| 3,840,953 | 10/1974 | Martin | 313/271 X |
| 4,812,710 | 3/1989 | Klan et al. | 313/273 X |
| 4,876,482 | 10/1989 | Stadler | 313/579 |
| 5,146,134 | 9/1992 | Stadler et al. | 313/579 |

FOREIGN PATENT DOCUMENTS

| | | |
|---|---|---|
| 0143917 | 6/1985 | European Pat. Off. . |
| 0173995 | 3/1986 | European Pat. Off. . |
| 459316 | 11/1913 | France . |
| 1147140 | 4/1969 | United Kingdom . |

OTHER PUBLICATIONS

Soviet Inventions Illustrated, Section E1, Week 8514, 15 May 1985, Derwent Publications Ltd., London, Great Britain.

*Primary Examiner*—Donald J. Yusko
*Assistant Examiner*—Ashok Patel
*Attorney, Agent, or Firm*—Frishauf, Holtz, Goodman & Woodward

[57] ABSTRACT

To permit ready insertion of a holding frame for a filament into an essentially tubular bulb, particularly a halogen incandescent lamp bulb made of quartz glass or hard glass, the frame has two legs extending along the wall of the bulb, connected by a holding portion to hold the filament at the end remote from the current supply leads to the filament, one of the legs of the frame is shorter than the other, for example only about one-third the length of the bulb. The longer leg of the frame can be pinch-sealed in a pinch seal closing off the bulb. The holding portion, which is intermediate the two legs, is preferably U-shaped to form a hook into which the filament can be hooked; or, particularly if the legs of the U are close together, about which the filament can be wound.

24 Claims, 8 Drawing Sheets

ELECTRIC LAMP WITH A HOLDING FRAME FOR A LAMP FILAMENT

The present application is a continuation-in-part of U.S. application Ser. No. 07/661,593, filed Feb. 26, 1991, now U.S. Pat. No. 5,146,134, patented Sept. 8, 1992.

FIELD OF THE INVENTION

The present invention relates to electric lamps, and more particularly to halogen incandescent lamps intended for general service use and for connection to a power network, for example of 110 V, 60 Hz, or 220 V, 50 Hz, nominal network voltages, and especially to support arrangements for the filament of the lamps.

Halogen incandescent lamps, for example of the type described in U.S. Pat. No. 4,876,482, Stadler, often use a cross support element, typically of quartz glass, to retain the current lead-ins and support wires, if desired. The published European Patent Application 0 173 995, Westlund et al, describes a single-ended lamp which does not use such a cross bar. The filament is retained only by a support wire which is melted-in together with the connecting foils in a pinch or press seal of the lamp. A lamp of this type, when designed for power network voltage, requires a filament having a relatively high resistance, and consequently of substantial length. The filament, to obtain this length, is bent into two luminescent arms, so that the general shape of the filament is approximately inverted-V shaped or inverted-U shaped.

It has been found, in operation, that the concept of the design of the aforementioned European patent application has some disadvantages. These lamps are sensitive to shocks and vibrations. If the lamp is subjected to a shock while it is lit, the two arms of the filament can touch each other. The portions of the filament which still have current flowing therethrough, thus burn out due to overloading. This is due to the application of the full network voltage over then only a fraction of the length of the filament. Usually, the engagement is about midway between the length of the filament legs, so that only half the normal filament resistance is present, causing burn-out and hence lamp failure.

If the lamp is operated in a horizontal position, the filament, due to sagging upon heating, can touch the interior of the bulb wall. The free length of the filament arms is comparatively long. Some hang-through or sag of the filament cannot be avoided; a typical hang-through is about 10%. Any contact of the filament with the lamp bulb causes blackening thereof and furthermore reduces the lifetime of the lamp.

Various types of holders for the filament have been proposed. For example, the referenced German Utility Model 19 52 467, Schmidt, describes a halogen incandescent lamp, particularly suitable for photographic use, which has a holder for a generally U-shaped filament, formed by a glass rod or glass tube which has at the end remote from the base one or more hooks to hold the filament melted therein. The filament itself is short, since a focussable light source is to be provided. The danger of engagement of the filament portions against each other upon shock or vibration, therefore, is low. The glass tube or glass rod is introduced into the pinch seal of the bulb and so positioned that a portion thereof is within the pinch seal, and coupled to the respective supply leads from the filament. Such a construction, at first glance, may also be suitable for general service halogen incandescent lamps. Yet, the requirements placed on service lamps for general illumination differ substantially from those of photo flood lamps, particularly with respect to lifetime and rated power. Price, also, is a factor. In photo lamps, the stability of the filaments is higher due to the usually greater diameter of the filament wires. Photo lamps, also, can be handled carefully since they are used only in specific controlled environments.

Glass rods or glass tubes located within halogen incandescent lamps of the type suitable in the photo lamp field have the tendency to blacken during the desired lifetime of a general service lamp, which is in the order of about 2000 hours. Further, due to the high temperature, for the long period of time, the tubes may devitrify. Blackening and devitrification indirectly lead to premature lamp failure. In photo lamps, which have a liftime in the order of about 50 hours, these effects are of minor importance.

THE INVENTION

It is an object to provide a holding frame is a unitary wire element and for the filament of an electric lamp, and especially a quartz halogen cycle incandescent lamp, which makes the lamp suitable for general service use, connectable directly to a power network, which holding frame is easily and inexpensively made, and, especially, can be made and installed by automatic machinery.

Briefly, a holding frame for the filament, which may be made in various ways, is provided within the bulb, which typically is a single-ended tubular bulb. The holding frame has two leg portions which are engaged against opposite walls of the tubular bulb. One of the leg portions is considerably shorter than the other, and between the two leg portions, an intermediate holding portion is formed which is dimensioned and shaped to engage the filament, and hold the filament in position within the bulb, for example by forming a small hook or tip over which a V-shaped or U-shaped filament can be hooked or on which it can be retained.

The lamps have a lifetime which substantially exceeds that of service-type incandescent lamps, that is, a rated life in the order of about 2000 hours. They are simple to construct since no additional cross elements such as cross straps or cross bars or bridges are needed. The tube dimensions can be reduced from previously known lengths. The diameter for example, by 2–4 mm, and the bulb length by, for example, 7 mm. Due to the smaller internal volume of the bulb, less fill material is needed.

The lamps are particularly suitable for direct connection to network voltages, which are voltages in the region of between 80 V to 250 V. Typical power ratings are from 15 to 500 W, although the lamps can be used with much higher power ratings, up to for example 2000 W. For general service illumination, the lamp can be surrounded by an outer bulb. The lamp, since it is compact, is also eminently suitable for use in reflectors, for example in PAR lamps, lamps having dichroic reflectors and the like, and can be based, as desired, with screw or pin bases. Preferably, the filament for a service-type is bent in inverted U or V shape, or it may be axially arranged. For single-ended lamps the tube diameter can be reduced by about 20% with respect to prior lamps and the length can be reduced up to about 30% because structural elements in the vicinity of the pumping stub need not be used with U-shaped filaments, so that the entire lamp bulb structure is simple.

The metal frame or metal support is preferably so arranged that one long leg extends along the bulb wall, and the second, shorter leg extends along an opposite bulb wall and is in engagement with the opposite bulb wall for a much shorter distance. This unsymmetrical arrangement, especially but not exclusively when used with a filament of U shape, has an advantage over a symmetrical arrangement as described, for example, in the European Published Patent Application 0 173 995, Westlund et al, in that it does not have the tendency to tip about the lamp axis during insertion.

DRAWINGS

FIG. 1*a* is a lamp having a metal holder in accordance with the present invention;

FIG. 1*b* is the lamp of FIG. 1*a* rotated 90°;

Figure 6A:
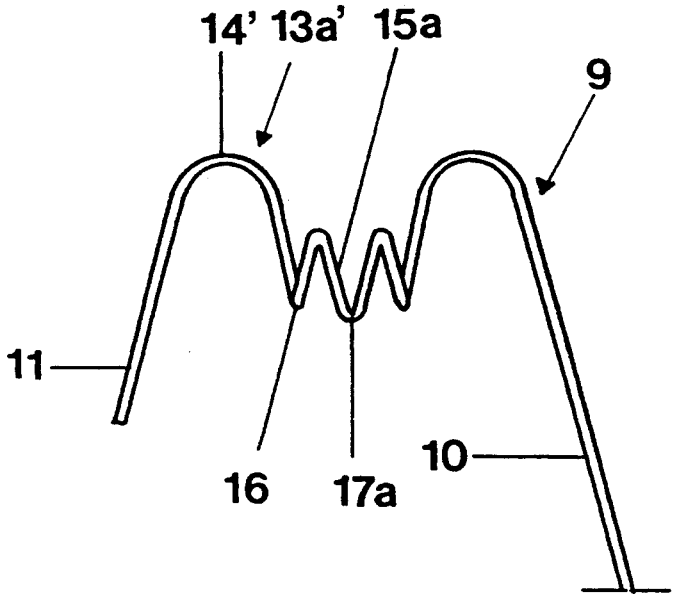
Figure 6B:
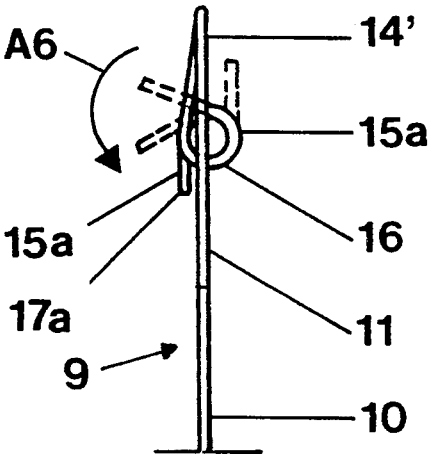

FIG. 6*a* is a fragmentary front view of another embodiment of the frame, similar to the embodiment of FIG. 1, before installation in a lamp;

FIG. 6*b* is a side view of FIG. 6*a;*

Figure 7A:
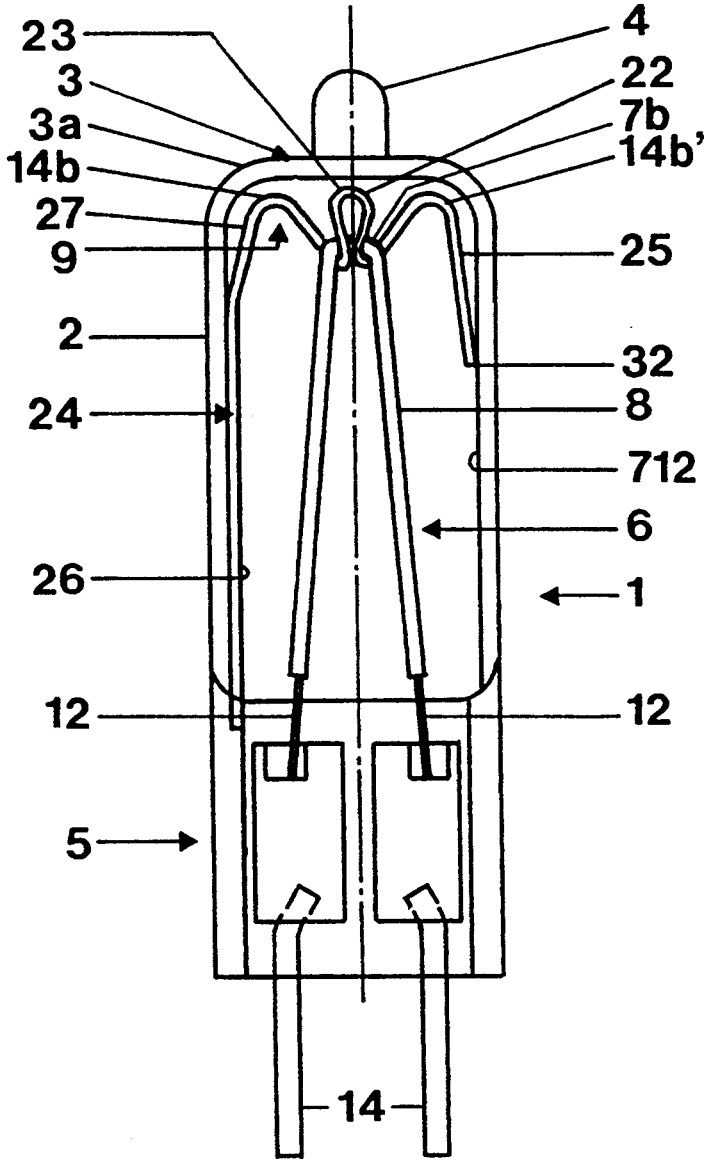
Figure 7B:
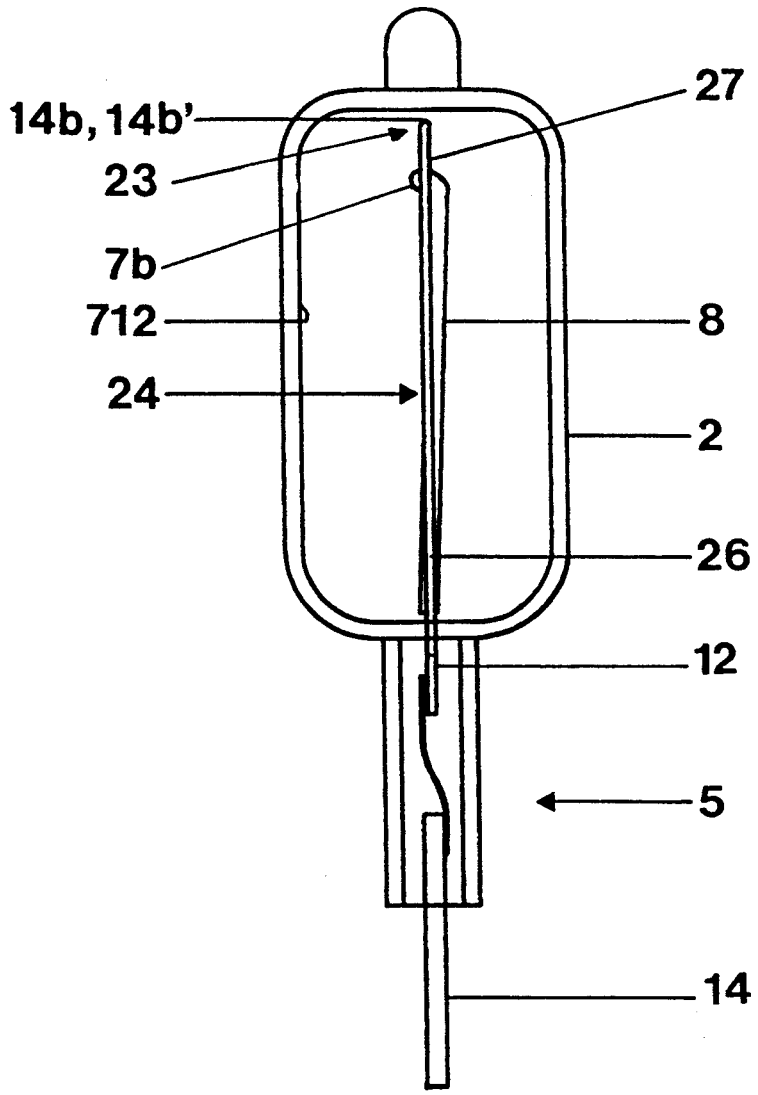

FIG. 7*a* is a front view of yet another embodiment of the frame installed in a lamp; and FIG. 7*b* is a side view of FIG. 7*a.*

DETAILED DESCRIPTION

The invention will be described partially with reference to a halogen incandescent lamp in which the material of the lamp bulb, for example hard glass or quartz glass, is deformed with internally projecting protuberances to form a support structure or separating structure for filaments within the lamp bulb. For a detailed description, reference is made to the parent application U.S. Ser. No. 07/661,593, filed Feb. 26, 1991, now U.S. Pat. No. 5,146,134.

Figure 1A:
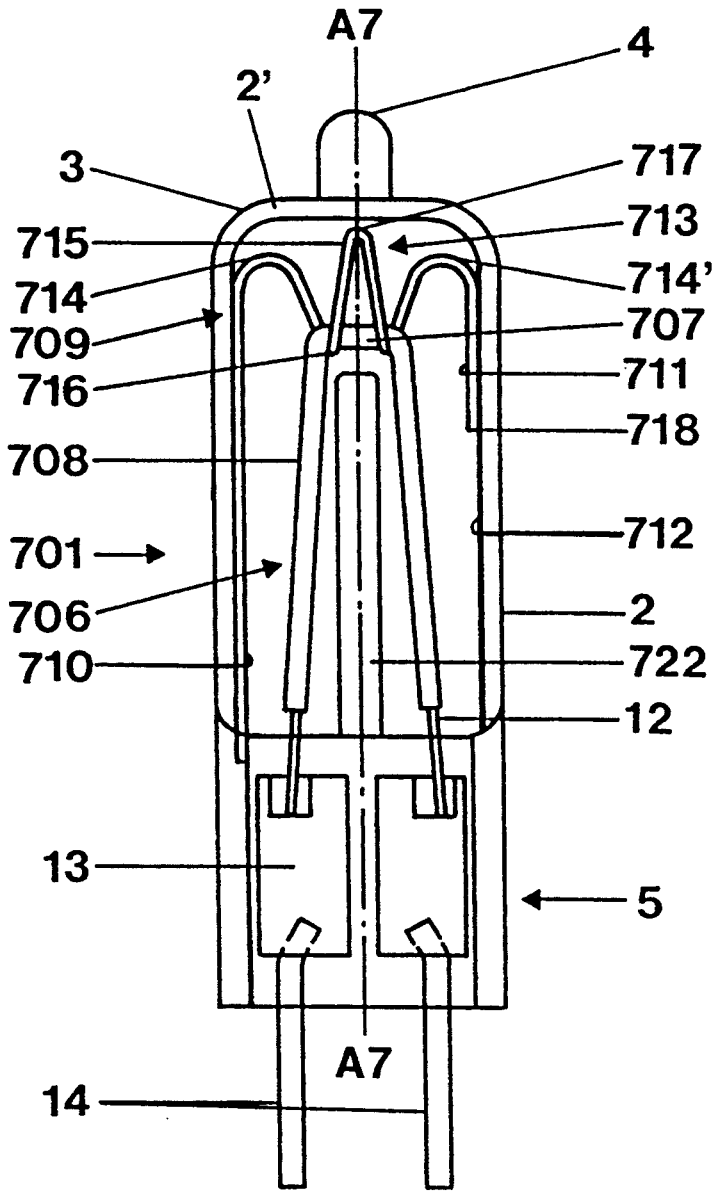
Figure 1B:
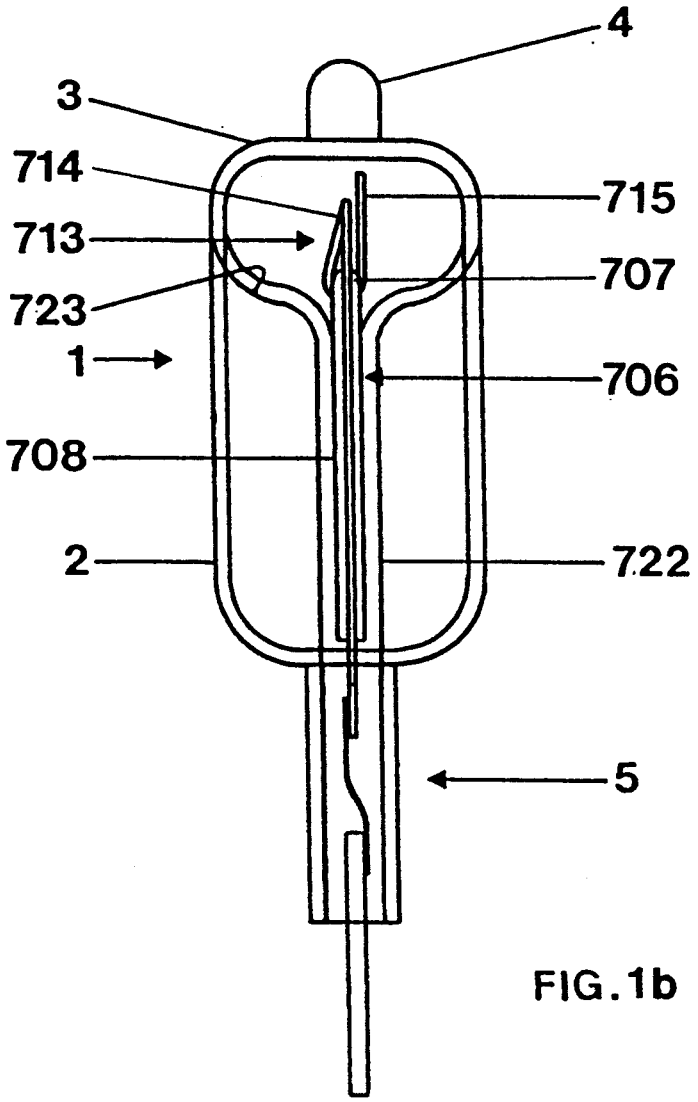

Referring first to FIGS. 1*a* and 1*b:*

The halogen incandescent lamp 701 is a 220 V, 75 W lamp, having an essentially cylindrical bulb 2 of quartz glass with an outer diameter (OD) of about 12.5 mm, an average wall thickness of the wall 2' of about 1 mm, and an internal diameter (ID) of 10.5 mm (with a tolerance of 0.8 mm). The overall length is about 35 mm. The cap 3 has the usual gas pumping tip 4. A pinch seal 5 closes off the bulb. The bulb has a volume of 1.65 $cm^3$, and is filled with a standard inert gas with halide additives, as described above.

The filament 706 is a coiled-coil filament and extends over essentially the entire inner length of the bulb. The base portion 707 of the filament, which is bent in U shape, extends transversely to the axis A7 of the lamp. The two legs 708 of the filament form the luminescent portions thereof; they are about 15 mm long. The arms 708 diverge slightly towards the pinch seal 5. The filament 706 is held by a support frame 709. Frame 709 is bent in a plane, which also includes the axis A7 of the lamp, in such a manner that a cross piece 713 extends transversely between the two legs 710, 711, which extend parallel to the axis A7 and are oppositely positioned against the inner wall 712 of the bulb. The cross element 713 spans across the inner space of the bulb.

In accordance with a feature of the invention, the two legs 710, 711 of the frame are of unequal lengths. The first leg, 710, is substantially longer than the second leg, 711. For example, leg 710 may have a length of about 21 mm, whereas leg 711 is only about 8 mm long. The leg 710 extends into the pinch seal 5 and is embedded therein (see FIG. 1*a*). Shortly beneath the cap 3, the leg 710 is bent over to form the intermediate portion 713 extending across the bulb 2. The intermediate portion 713 is undulated, looked at from the front-see FIG. 1*a*-to form three upwardly bowed or bulged regions 714, 714', 715. The first and third portions 714, 714' are bent in essentially semi-circular form; the intermediate bump 715 is bent sharply to form a point 717, and to provide a hook, in combination with the root portions 716, which support the filament 706.

The hook 715 is slightly offset with respect to the plane of the frame, in axial direction. The tip 717 of the hook terminates beneath the cap 3 of the bulb 2.

The base portion 707 of the filament is hooked into the hook 715, so that the ends of the base portion 707 engage the roots 716. The region of the base portion 707, thus, is electrically short-circuited by the frame 709, which is made of metal.

The intermediate portion, forming a cross element of the frame, in front view, is symmetrical with respect to the axis A7. The respective bumps or humps 714, 714' merge with the respective legs 710, 711 of the frame. The free end 718 of the second leg 711 is left with a cut edge, which may still have a cutting burr on it. This cut edge is not finished.

The frame 710–718 is retained in the bulb by spring tension. Before being installed in the bulb, the two essentially semi-circular regions 714 are outwardly spread.

The two legs 708 of the filament 706 are connected to supply leads 12, which can be, for example, extensions of the filament which are short and, for example, single-coiled, and welded to suitable sealing foils 13. The filament 706 is tensioned or stretched by the frame and the retention of the connecting leads 12 in the pinch seal 5. The current supply leads 12 have a length of, for example, about 6 mm and extend by a very short distance, for example 1–2 mm, into the bulb. This short connecting length permits elimination of core pins or the like, which have been used for stabilization of the filament. Contact pins or connections 14 are welded to the sealing foils 13, as well known, and extend upwardly of the pinch seal 5.

A separating wall 722, forming a protuberance extends into the outline of the bulb, along the axis A7 of the lamp, and longitudinally about almost as long as the length of the two filament arms 708. The transition between the cylindrical wall 2 of the bulb and the separating wall 722 is formed by an outwardly bulging region 723. This provides for an essentially homogeneous wall thickness of the bulb, including the internal protuberance formed by the separating wall 722. The separating wall 722 has a width of about 1 mm, each wall portion a thickness of about 1 mm, and an axial length of about 10 mm.

Various changes may be made, both in the construction of the lamp as well as in the arrangement of the frame and the relationship thereof to the filament.

Figure 2:
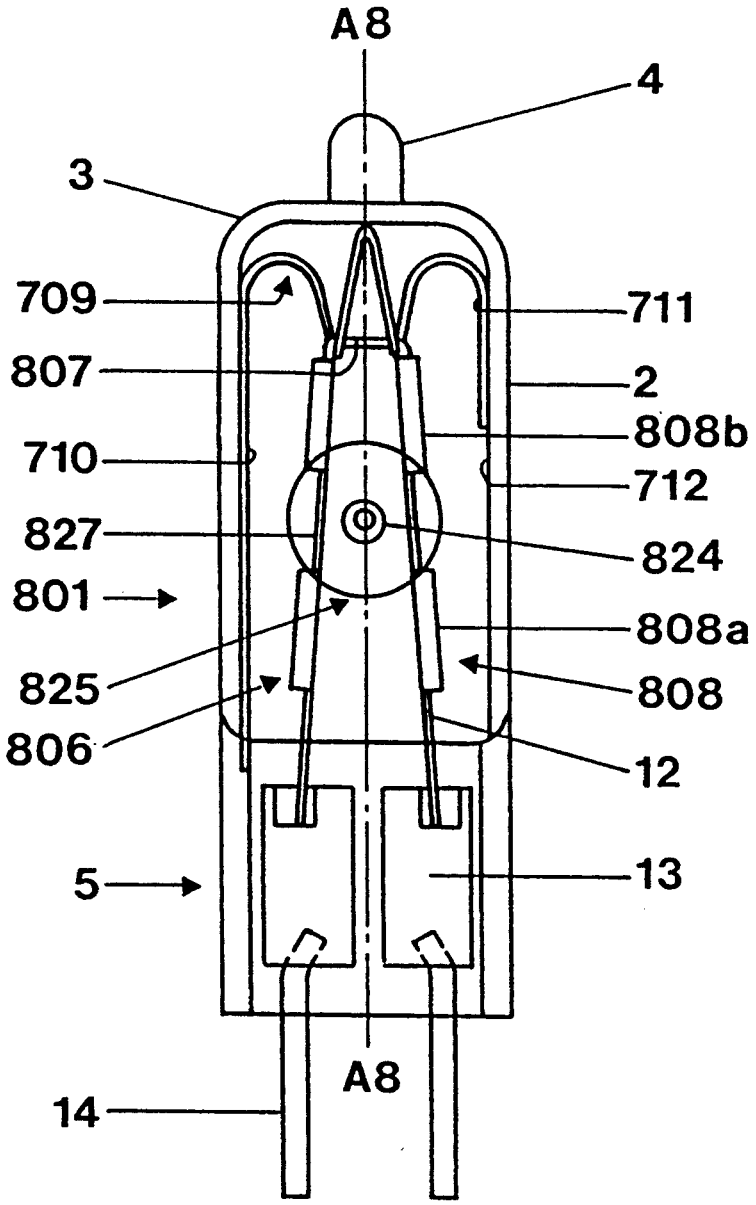
FIG. 2 is a front view of another type of lamp, and showing the holding frame.

Referring now to FIG. 2:

The general construction is similar to that shown in FIGS. 1*a* and 1*b*. The separating portion between the legs of the filaments 808 is not formed as a longitudinally extending wall but, rather, by two funnel-shaped glass tubes 824, extending from the circumference of the bulb wall 2 towards the axis A8 of the lamp.

The glass tube 824 has an inner diameter of about 1.2 mm in the vicinity of the axis A8, and extends outwardly towards the wall of the bulb 2 in form of a funnel 825, expanding to between twice to four times its diameter with respect to the diameter close to the axis A8. A plug 826 can be left at the end of the tube 824. The filament 806 is bent in inverted U shape. The two incandescent, luminescent arms 808 are separated into two portions 808*a* and 808*b*. The incandescent portions 808*a*, 808*b* are coiled-coil; the portions 827 are singly coiled. The base portion 807 is either straight, singly coiled or double coiled. The connecting portions 827 have approximately the same length as that of one of the highly luminescent portions 808*a*, 808*b*, that is, about 5 mm long. They are spaced from the glass rib 824 by about 1.5 mm. They can touch the glass rib only if, under shock or vibration, or upon operation in a horizontal direction and sagging of the filaments, the two arms 808 will not have the position shown in FIG. 8*a*. Thus, problems with respect to blackening of the glass at that location hardly arise.

The filaments can be retained within the glass protuberances or ribs, while, simultaneously, being supported at the bend of the U by the frame in accordance with the present invention. The lamps have the usual lamp parts, that is, a cylindrical bulb 2 of quartz glass for example with an outer diameter of 12.5 mm, an inner diameter of 10.5 mm, with a tolerance of 0.8 mm. The overall length is about 35 mm. The upper end of the bulb 2 is formed with a rounded cap 2' having an exhaust and fill or pumping tip 4 at an upper end portion 2'. The other end of the bulb 2 is closed off by a pinch seal 5. The interior volume of the bulb is 1.65 $cm^3$, and filled with a standard inert gas of crypton, nitrogen, and a suitable halide additive, for example 0.005% $CBrClF_2$. Another example of a suitable additive is $CH_2Br_2$. Molybdenum foils 13 are retained in the pinch seal 5, to which external current supply leads 14 are welded. Internal current supply leads 12, welded to the foils 13, and of an overall length of about 6 mm extend from the pinch seal 5 by about 1 to 2 mm into the bulb. This arrangement permits elimination of core pins, used in prior art lamps. The usual bulb material is quartz glass. For lamps of low power, for example below 100 W, hard glass may be used. The critical temperatures for stresses within the glass material of hard glass is below about 600° C. To prevent overheating of the hard glass, use of core or mandrel wires which short-circuit the filament or coils of the filament in the region 827 where the filament comes in contact with the glass, for example at the inwardly extending protuberances 824, is recommended. The separating rib or protuberance 824, FIG. 2, should be spaced from the filaments by at least 3 mm if the bulb is made of hard glass.

The lamp can be made economically, for direct connection to a power network with as low a power consumption as 15 W.

The frame structure 709, 710–718 can be used also in incandescent lamps which do not use a glass protuberance or rib, imagine, for example, FIGS. 1 and 2, respectively, without glass protuberances 722 and 824, respectively. This frame structure has substantial advantages over that described for example, in European Published Application 173 995, Westlund et al. It has been found that if the legs 710, 711 of a frame are of approximately the same length, they must be introduced into the lamp in a jig since, otherwise, they will cant. This interferes with the pinch sealing and, particularly, the bent-over end portion in the pinch seal, as described in this patent application, causes difficulty upon pinch-sealing since the legs have the tendency to spread outwardly. During pinch-sealing, of course, the glass is heated and thus is soft and the spring tension of the frame legs has the tendency to cause the softened glass to deviate outwardly, resulting in a high reject rate upon manufacture of the pinch seal, or the formation of fissures, which interfere with gas-tightness of the lamp. Additionally, it is difficult to thread the filament; the threading operation can hardly be carried out automatically. Supporting the top portion of the filament within the exhaust stub 4 substantially interferes with pumping, flushing, and introducing of the fill gas. The arrangement of the lamp described in this publication only permits the use of V bent elements, which has the danger of short circuit at the converging ends of the legs of the V.

The holding frame 709 in accordance with the present invention, in contrast, has the advantage that the length of the leg which is not melted into the pinch seal can be readily matched to the length of the lamp bulb, so that one single frame can be used for various types of bulbs. Introduction can be completely automated, and the inner construction of the lamp substantially simplified. By leaving a cutting burr at the shorter leg 711, self-holding of the wire frame upon introduction into the bulb will obtain. Thus, the position of the holding wire, and hence of the incandescent filament, is precisely determined, and the frame and hence the filament cannot cant. The filament is held in tensioned condition and, if necessary, can be re-tensioned. The shorter leg 711 should be at the most half as long as the longer leg. Surprisingly, the unsymmetrical construction of the legs eliminates difficulties upon tilting or canting and does not introduce twist or tilt into the frame, which had been feared, and which might be expected from a purely theoretical consideration. In actual practice, a length relationship of the two legs 710, 711 of about 3:1 has been found suitable. Canting of the frame might occur if the length of the shorter leg 711 is decreased substantially. The legs are straight, and engage the inner wall of the bulb 2 throughout their length. The arrangement further does not place any tensioning load on the pinch seal 5, since hardly any remaining outwardly directed spring forces will be applied thereagainst. Most of the spring forces due to the springiness of the frame distribute themselves along the entire inner wall of the bulb 2, thereby substantially increasing the tightness of the lamp and hence its lifetime. The shortened leg has the additional advantage that shading of light emitted from the filament is reduced.

The hook-like arrangement determined by the central hook 717 (FIG. 1*a*) simplifies hooking the filament 706 into the frame, thus eliminating any threading operation, and, hence, placement of the filament structure and frame can be readily automated. The tip 717 of the hook, preferably, engages against the caps 3 of the bulb 2, which provides a simple way of readily determining an abutment stop which controls the correct positioning and insertion depth of the frame.

Short-circuiting of the portion of the filament between the roots 716 of the central projection is deliberately accepted, so that the two highly incandescent portions of the filament are spread apart, much more so than in a V-shaped filamentary arrangement, and danger of short-circuiting between opposite legs, and hence reduction in lifetime or immediate burn-out of the filaments is avoided.

The concept of providing a frame with non-symmetrical frame legs, and of forming supports for the filaments directly from the material of the glass bulb, can be used also with filaments which extend longitudinally of the lamp and in the lamp axis. Single-ended lamps of this type have a current supply lead which extends from the connection end to the cap end of the bulb and which, at the same time, may also form part of a holding arrangement for the axially positioned filament.

Figure 3:
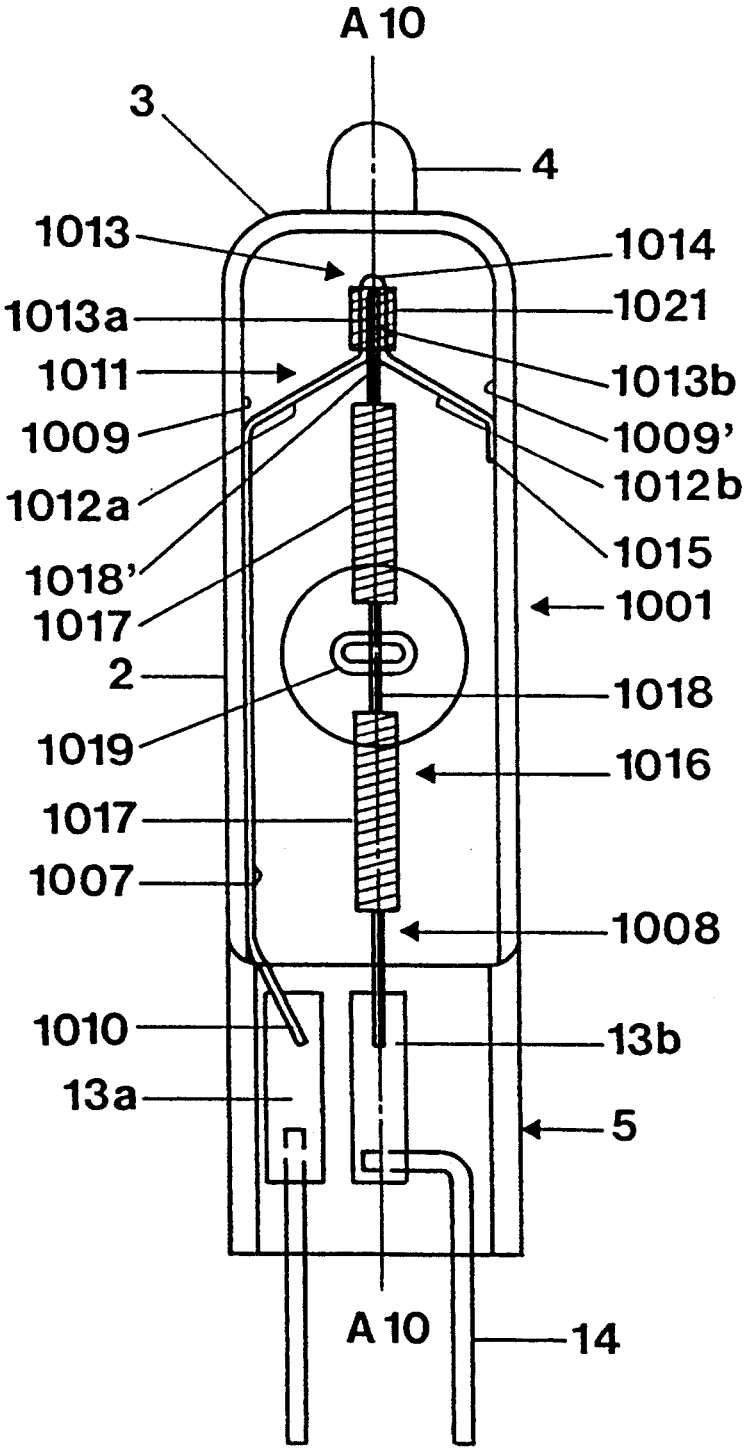
FIG. 3 is a front view of yet another type of lamp with the holding frame of the invention.

Referring now to FIG. 3:

Lamp 1001 is a 120 V, 90 W lamp, having a cylindrical outer bulb 2 of quartz glass with an overall length of about 4 cm. It has a rounded cap 3 and an exhaust-and-fill tip 4. The other end of the bulb 2 is sealed with a pinch seal 5, from which leads 14 extend, for example for connection to a base of ceramic or the like-not shown. Two molybdenum foils 13*a*, 13*b* are asymmetrically positioned in the pinch seal 5, and, respectively, connected to the outer leads 14 and to inner current supply leads 1007 and 1008. The first current supply 1007, made of tungsten wire, is long and guided along the inner wall 1009 of the bulb 2 towards the cap end of the bulb. The end 1010 of lead 1007 is bent inwardly away from the inner wall 1009 of the bulb 2 and towards the connecting foil 13*a*, located at a lateral end portion of the pinch seal. The end 1011 of the lead 1007 is bent inwardly towards the axis A10 of the lamp to form a first inclined portion 1012*a*, bent upwardly to form an angle of about 60° with respect to the lamp axis A10. Shortly before this portion meets the lamp axis, a sharply reverse bent portion 1013 is fitted thereon; it can be unitary with the entire current supply lead 1007. It is hair-needle shaped and formed by a leg 1013*a* and, immediately adjacent, a downwardly extending leg 1013*b*. The bend 1014 of the portion 1013 is directed towards the pumping tip 3. It is, however, spaced therefrom, as can be clearly seen in FIG. 3, by a sufficient clearance distance.

In accordance with a feature of the invention, the current supply lead 1007 is in form of the frame. The frame formed by the current supply lead 1007 is mirror-symmetrical with respect to the lamp axis in the upper region thereof. Thus, symmetrical to the first leg 1013*a* and the first inclined portion 1012*a*, a second 1013*b* and the second inclined portion 1012*b* are provided. The second inclined portion 1012*b* ends at the opposite inner wall 1009' and terminates in a short extension 1015, bent over to follow the inner wall 1009', and direct it towards the pinch seal 5. This retains the inner current supply 1007 resiliently between two diametrically oppositely positioned points or regions of the inner wall of the bulb and centers the filament 1016 automatically in the axis A10 of the lamp.

The filament 1016 has two double-coiled or coiled-coil portions 1017; it is axially retained in the bulb between the second sealing foil 13*b* and the portion 1013, by being stretched or tensioned therebetween. The two coiled-coil portions 1017 are separated from each other by a single coil connecting portion 1018. The end portion 1008 likewise is singly coiled, and extends in a straight line from the highly light emitting portion 1017 to the second foil 13*b*, positioned symmetrically in the axis A10 of the lamp, and in the middle of the pinch seal 5. This construction substantially simplifies the overall lamp, since it eliminates the need for a second current supply to the filament, by using a portion of the frame thereof. Further, and unexpectedly, an additional safety feature is obtained since the end portion 1008 of the filament is pinch-sealed into the pinch seal 5. This leaves a short duct or channel. If, due to over-voltage or other malfunction, an arc should strike between the current supply leads within the bulb, the filament portion 1008 will vaporize, thus immediately suppressing any dangerous continuous arc formation.

The connecting portion 1018 of the filament 1016 is fixed in position within the bulb by a glass rib 1019, extending transversely to the lamp axis A10, and to the first current supply lead 1007. The glass rib 1019, in accordance with a feature of the invention and as heretofore described, is hollow and extends, from both sides of the bulb, up to approximately the center thereof. The glass tube, close to the lamp axis A10, has an interior diameter of about 1–2 mm, and extends, funnel-shaped, towards the wall of the bulb with a final diameter of between two to four times the minimum diameter.

In its simplest form, the tubular rib extending from both sides of the bulb, has circular cross section. In accordance with a feature of the invention, in a preferred form for longer filaments, as best seen in FIG. 3, the rib is of transversely stretched or oval cross section, at least in the region close to the central axis A10 of the bulb. This facilitates locating the filament precisely in position. The longer axis of the hollow rib extends transversely to the lamp axis A10 and, hence, to the major direction of the filament 1016. The relationship between the longer and the shorter axis of this hollow rib is approximately 2:1. The connection portion 1018 of the filament is squeezed or pinched between the two oppositely extending rib portions of rib 1019. Adjacent the center axis, a plug will remain in each one of the inwardly projecting ribs or protuberances.

The rib 1019 carries out a portion of the function of a holding frame. A further holding function is obtained by the inner current supply lead 1007, which retains the end of the filament 1016 in position at the end close to the cap 3 of the bulb. The filament 1016 adjacent the upper end, is formed with a connecting portion 1018', which is, in turn, connected to a double-coiled or coiled-coil end portion 1021. This end portion 1021 is threaded on the reversely bent region 1013 of the current supply lead 1007. The two spreading legs 1012*a*, 1012*b* ensure that the end portion 1021 cannot slip off. Preferably, the intermediate connecting portion 1018' is only single-coiled.

Figure 4:
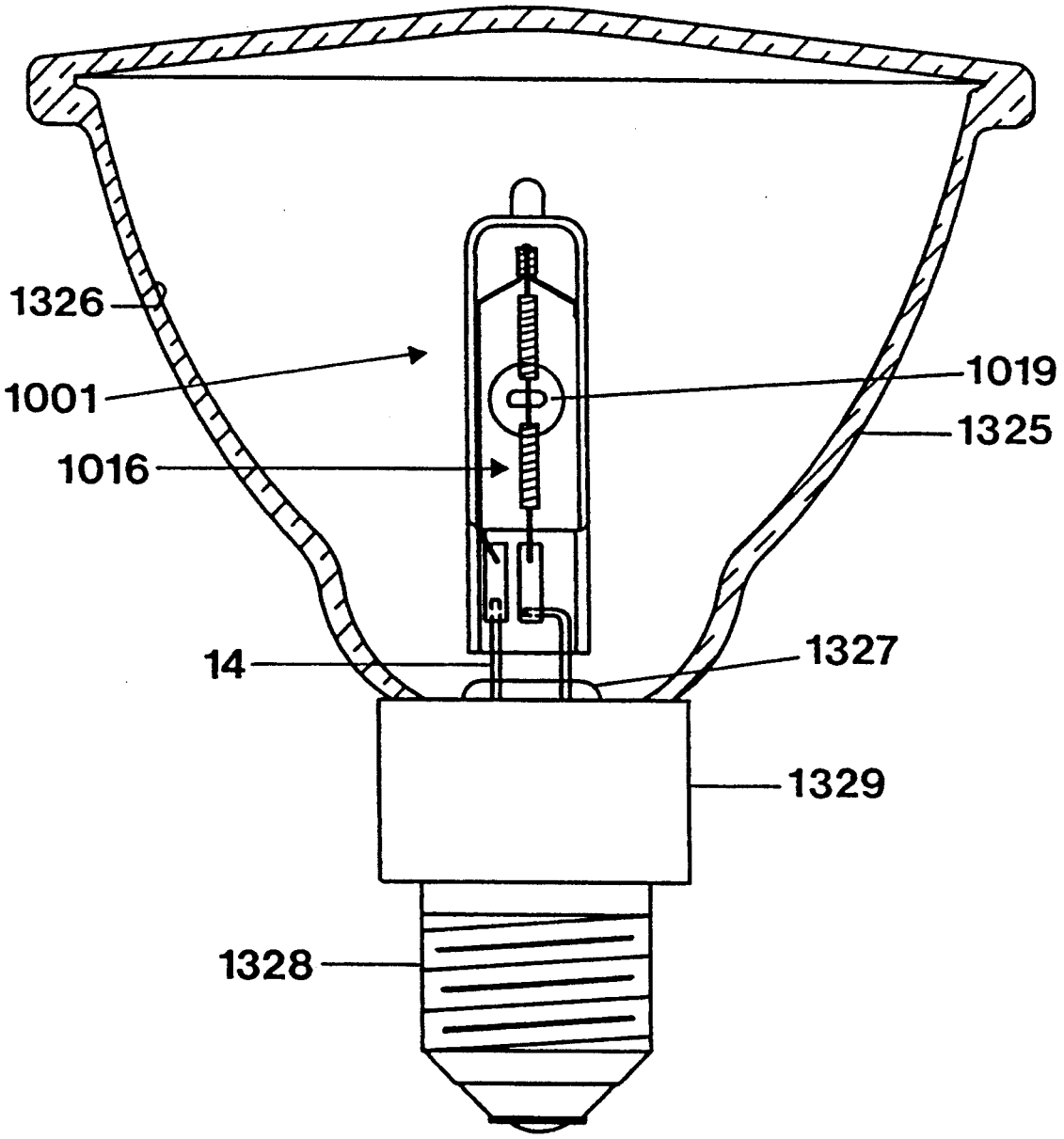
FIG. 4 shows a lamp with the holding frame within a reflector to form a PAR reflector-type lamp unit.

The lamp of FIG. 3 is particularly suitable for incorporation into an outer bulb and, especially, for incorporation in a reflector bulb, where placement of the filament in a focal plane is desirable. FIG. 4 illustrates the lamp 1001 in a PAR reflector 1326. The two external current supply leads 14 are connected and retained with a flare mount 1327, which is retained in a base 1329, formed with a screw base connection 1328. The outer bulb 1325 is evacuated.

The connection of the filament 1016, may, also, be positioned transversely in the pinch seal. This may simplify the overall construction, since then the necessity of bending the current supply lead connected to the centrally positioned foil may not be necessary. Of course, such an arrangement requires use of the filament 1016, or a portion 1008 thereof, as the current supply lead to the foil.

The glass bulb 2 may have either circular cross section or, particularly for longer bulbs, oval cross section, for example elliptical, which can be of advantage. The connecting ribs 1019 then should extend in the direction of the shorter axis to ensure an appropriate minimum thickness of the glass ribs.

The arrangement of the frame formed by the current supply lead 1007, in accordance with the invention, has a substantial advantage over prior art structures, such as, for example, disclosed in the referenced U.S. Pat. No. 3,840,953, Martin. By placing the current supply lead against the inner side wall, and providing a second and short leg 1015, the two inclined portions ensure precise centering of the filament, important when combined with a reflector. The angle which the inclined portions 1012*a*, 1012*b*, each, form with respect to the lamp axis can vary widely, and may be between 10° to 80°. Eliminating a connection of the holding arrangement for the filament with the cap end of the bulb facilitates evacuation, flushing and filling of the bulb.

The frame structure described herein may also be used with lamps other than halogen incandescent lamps.

Figure 5:
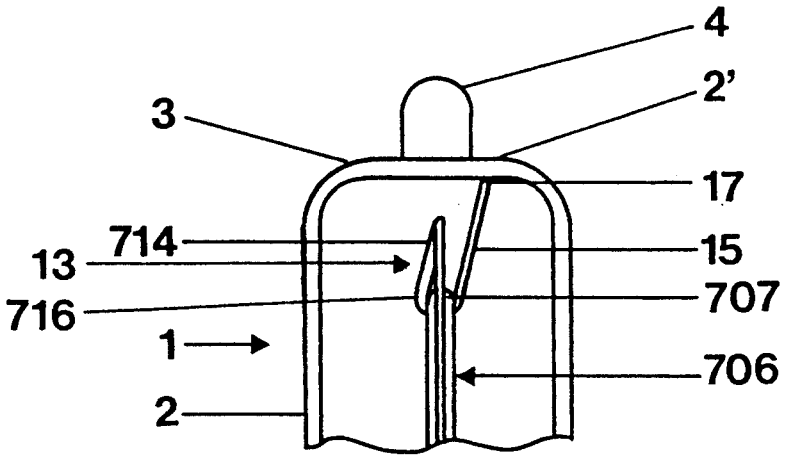
FIG. 5 is a fragmentary side view of another embodiment of the frame similar to the embodiment of FIG. 1.

Referring now to FIG. 5:

The general structure of the frame is similar to that previously described, especially in FIG. 1*b*. Contrary to the prior embodiments, however, the hook 15 is slightly bent out of the parallel plane of the frame, and inclined by about 15° with respect to the axis of the lamp. The tip 17 of the hook 15 terminates against the cap region 3 of the bulb 2, that is, at the flat surface 2' thereof, in a region which is outside that of the exhaust tip or pumping tip 4. This has the advantage that the pumping tip 4 is readily accessible during the pumping and filling processes in making the lamp, while, at the same time, providing for a simple engagement position of the frame against the interior of the bulb.

The cross portion 13 of the frame, just as the cross portion 713 in the prior embodiments, is bent out of the central plane of the bulb in opposite directions several times, so that the transverse portion 707 of the filament can intersect the axis of the lamp and the plane of the entire filament structure 706 is within the plane which includes the lamp axis. The two upwardly extending loops 714, 714' of the frame are slightly bent in one direction from the plane of the remainder of the frame, so that the bottom portions 716 thereof intersect the plane of the frame, and the hook 15 is bent from that plane in the other direction.

The exact suspension of the filament in the plane of the frame which surrounds the lamp axis is also obtained in the embodiment of FIGS. 6*a*, 6*b* which is very similar to FIG. 1. This embodiment, like the prior ones, reliably prevents undesired release of the filament structure from the frame. FIGS. 6*a* and 6*b* illustrate the frame, or, rather, the filament support portion 9 thereof, before introduction into a light bulb. As can be seen, the two legs 10, 11 are spread outwardly. The V-shaped hook 15*a*, which is originally formed from two legs arranged at an acute angle, is bent backwardly from a position parallel to the axis of the lamp and, see the arrow A6 in FIG. 6*b*, is bent even further backwardly until the region of the tip 17*a* is again parallel to the axis of the lamp but at the other side of the plane thereof. The tip 17*a* now faces the base 5 of the lamp. Bending the hook 15*a* in this manner, completely surrounds the upper portion 707 of the filament structure—not shown in FIGS. 6*a*, 6*b*—resulting in a particularly good mechanical support as well as electrical contact for the filament.

The foregoing embodiments of the frame are particularly suitable for halogen incandescent lamps in reflectors, or with outer bulbs which contain reflecting characteristics, in which high requirements are placed on exact orientation of the filament. Generally, they are particularly suitable for association with any structures which require precise positioning, for optical reasons.

FIGS. 7*a* and 7*b* illustrate embodiments which are particularly simple to make. The frame is located exactly in a central plane and, rather, the filament is slightly offset from this central plane. The cross or transverse portion 7*b* of the filament 6 is held by a rounded hook 22, the top part 23 of which does not engage the interior of the bulb. The first leg 24 of the frame is formed by a long straight portion 26 and a short, inwardly bent portion 27. The straight portion 26 is in engagement with the inner wall 12 of the bulb for about 85% of the overall length of the leg 24, starting from its inclusion in the pinch seal 5. The remaining 15% of the region 27 provide first for a slightly inwardly bent portion and then a smooth transition to the first hook-like protuberance 14*b*. The protuberance 14*b* then smoothly merges into the rounded hook 22, followed by the second protuberance 14*b'* which, in turn, terminates in an inwardly inclined leg 25. Leg 25 is short, and its free end 32, which may have a burr 32 on it, engages the inner surface of the bulb, and is resiliently retained thereagainst.

The construction of FIGS. 7*a*, 7*b* permits to utilize almost the entire inner length of the bulb for the interior structure, since it also considers the rounding 3*a* of the cap 3, and can be used with bulbs which do not have a flat top surface. In accordance with a feature of the invention, by suitable choice of the length of the free leg, which is not melt-sealed in the pinch seal, the holding effect of the structure can be readily matched to tolerances within the dimensions, especially the inner diameter, of the lamp bulb. This is an advantage over prior art structures.

The resilient compression of the legs from the position shown in FIG. 6*a*, for example, to that shown in FIGS. 7*a*, 7*b*, provides for excellent self-holding of the frame, and alignment upon introduction of the frame into the bulb. It provides, even during insertion, for precise positioning of the filament with respect to tipping and tilting in contrast to the frames already known. The filament is held in stretched condition and, if necessary, can be additionally stretched in case an original insertion was not as intended with respect to stretching. The self-holding effect is particularly enhanced by leaving a cutting burr at the end 32 (FIG. 7*a*) of the shorter leg, which should preferably be no more than half the length of the longer one. The non-symmetrical construction of the legs has the surprising effect that, in spite of the dissymetry, difficulties with respect to inclined position of the frame upon introduction into the lamp are avoided. For actual practical use, a relationship of the shorter leg to the longer leg of about 1:3 is preferred. Inclination of the frame has been observed only if the length of the shorter leg was reduced substantially beyond this relationship.

The legs, which for a certain portion of their length at least, engage the inner wall of the bulb, provide for stabilization.

The construction has the additional advantage that the pinch seal is hardly loaded thereby, since only a very small portion of the externally directed spring forces are applied in the region of the engagement of the pinch seal with the longer frame leg. These forces, rather, distribute themselves along the entire wall of the bulb, which substantially improves the tightness and seal, and hence substantially increases the lifetime of the lamp in comparison to lamps in accordance with published European Patent Application EP-PA 173 995.

The reduced length of the one leg has the additional advantage that the shadow effect of the frame with respect to emitted light is reduced over a portion of the length of the lamp.

In accordance with a preferred feature of the invention, the frame is constructed in accordance with FIG. 5, where a portion of the frame engages against the inner wall of the bulb, but offset from the exhaust or pumping stub. The hook construction according to the invention substantially simplifies insertion of the frame and engagement with the filament structure, permitting complete mechanization of the support of the filament. Engaging the top of the hook against the cap of the wall according to FIG. 5 provides for a particularly simple way of finding the correct position of the frame within the bulb.

The frame construction, as has been intended, provides for a short circuit of the cross or transverse portion of the filament, keeping in mind that in this region of the filament there is no need for the emission of much light. Thus, this arrangement with a U-shaped filament (FIG. 7*a*, for example) permits substantial separation of the two light emitting portions or legs 8, which eliminates danger of a short circuit between the hot portions of the filament section in operation. In contrast, a V-shaped filament having but slight separation between the two filament portions would substantially reduce the lifetime of the lamp.

Incandescent filament structures can be selected which use as supply leads only a single-coiled end portion of the filament, without using core pins for stabilization thereof. Long filament end portions used as current supply leads were considered to require core pins. Elimination of core pins increases the operating reliability of the lamp, which is particularly important for general service illumination purposes. Formation of arcs between the current supply leads in the lamp bulbs is effectively eliminated, since the coiled filaments form at the same time hollow current supply leads which, due to the coiling, have the effect of blow hoses or blow nozzles, which, if an arc should follow, tend to immediately blow out an arc due to vaporization of the filament winding. The high ejection speed of the vaporizing filament from the hollow, remaining filament structure tends to blow out any arcs which may form between the current supply leads. The resulting pressure, and heating within the region of the pinch seal 5, is so small, however, that an explosion of the bulb is effectively prevented.

The frame of the present invention permits elimination of a cross beam, for example of quartz glass, and eliminates contamination resulting from such a structure within the lamp. The construction is simpler than prior art constructions, using fewer separate components, and thus permitting reduction of the size with respect to prior art standardized halogen incandescent lamps. Thus, for example, the diameter of the bulb could be reduced by about 2 mm over prior art lengths, and the overall length of the lamp, with equal power rating, reduced by about 7 mm. Thus, due to the smaller free volume within the bulb, smaller quantities of fill gas need be used, which is a further saving in manufacture.

The lamps can be used with widely varying power and supply voltages in the region of about 80 V to 250 V, for example, with power ratings, typically, between 15 W to 500 W, although substantially higher ratings may also be used.

The invention is not limited to the embodiments shown; for example, it is equally applicable for halogen incandescent lamps in which the filament portions are subdivided even further. The resistance of the filament against vibration and shock can be further improved, as well known. The structure is particularly suitable for very small-power halogen incandescent lamps, down to about 15 W, designed for direct connection to a power network, particularly adapted for general service illumination.

The frame 9,709,1007 is preferably made of tungsten wire having a diameter of about 0.28 mm. The filament 708, 808*a*, 808*b*, 1016, 6, is preferably a coiled-coil, or double-coiled filament having single coil end portions 12 which are welded to the molybdenum foils 13 and partly melt-sealed in the pinch seal 5; for a 75 W, 220 V, lamp, a suitable length for the portion of the current supply leads 12 extending from the pinch seal 5 is about 1 mm, the overall length of the at least in part single-coiled end portions 12 being about 6 mm. This permits elimination of the otherwise customary core pins for stabilization.

Various changes and modifications may be made and any features described herein may be used with any of the others, within the scope of the inventive concept. For example, the length of the second or shorter leg of the frame could be about 10 times the tolerance of the interior diameter of the bulb, and comprise a wire in the order of from about 0.25 to 0.3 mm diameter. A suitable depth of embedding the longer leg 10, 25, 710, 1007 in the pinch or press seal is about $1\pm0.5$ mm. The frame is particularly suitable for bulbs in which the relationship between the inner longitudinal dimension of the bulb and the inner diameter is greater than 1.5:1.

Any of the frames described may be used with bulbs with the inward protuberance 722, 824, 1019, or without such a protuberance (FIGS. 7*a*, 7*b*).

We claim:

1. In combination with a lamp (1, 1001) having
an essentially tubular bulb (2);
a pinch or press seal (5) at one end of the bulb; and
a filament (6) positioned within the bulb,
a holding frame (709) for said filament, said holding frame comprising
a unitary wire element devoid of a cross strap or cross bar, said frame having
two leg portions (710, 711; 1007, 1015) and an intermediate holding portion (714, 714', 715; 1012, 1013) formed intermediate said leg portions and dimensioned and shaped to engage said filament and hold said filament in position within the bulb;
wherein one of said leg portions forms a shorter leg portion (11; 25; 711; 1015) which is substantially shorter than the other leg portion, said other leg portion forming a longer leg portion (10; 26; 710; 1007),
said longer leg portion being melt-sealed in, and retained in said seal (5), at least part of said longer leg portion (10; 26; 710; 1007) extending parallel to the lamp axis, engaging against an inner wall surface of said bulb at a first region (1009) thereof, said shorter leg portion (11; 25; 711; 1015) engaging against the inner wall of the bulb at a region (712; 1009') opposite said first region and said longer leg portion, said shorter leg portion terminating intermediate the length of the bulb, whereby said longer leg portion and said shorter leg portion will be, with respect to longitudinal extent of the bulb, nonsymmetrically positioned therein.

2. The combination of claim 1, wherein the intermediate holding portion includes a first inclined portion (1012*a*) angled off towards the axis (A10) of the lamp approximately at a level of the end of the filament which is closest to an end portion of the bulb, said first inclined portion being connected to a filament retaining portion (716, 717; 1013), said filament retaining portion being coupled to a second inclined portion (1012*b*), which merges with the shorter leg portion (711, 1015).

3. The combination of claim 1, wherein said two leg portions include converging bent or bowed portions (714, 714'; 14*b*, 14 14*b'* adjacent said holding portion; and the holding portion is a hook-like element (15, 17; 715, 717; 22; 15*a*, 17*a*) into which said filament is hooked.

4. The combination of claim 1, wherein two current supply means (13; 13*a*, 13*b*) are provided, extending through said pinch or press seal (5); and wherein the longer (1007) leg portion is electrically connected to one of said current supply means (13*a*) and forms a filament current supply connection within the pinch or press seal (5) of the bulb (2).

5. The combination of claim 4, wherein the shorter (1007) leg portion is directly connected to the other of said current supply means.

6. The combination of claim 5, wherein said current supply means comprise metallic foils pinch-sealed into said pinch or press seal (5); and wherein the longer (1007) leg portion is electrically and mechanically secured to one of said foils within the pinch or press seal, and extends into the bulb from said pinch or press seal.

7. The combination of claim 1, wherein (FIG. 3) said intermediate portion (1013) of the frame includes a U-shaped region defining U legs (1013*a*, 1013*b*); and an end portion (1021) of the filament is wound around the U legs of the U-shaped region of the intermediate portion (1013).

8. The combination of claim 7, wherein the U legs are close together.

9. The combination of claim 7, wherein two current supply means (13; 13*a*, 13*b*) are provided extending through said pinch or press seal; and wherein the longer (1007) leg portion is electrically connected to one of said current supply means (13*a*) and forms a filament current supply connection within the pinch or press seal (5) of the bulb (2).

10. The combination of claim 1, wherein the length of the shorter leg portion (11, 26, 711, 1015) is about 10 times the dimension of manufacturing tolerance of the inner diameter of the bulb (2).

11. The combination of claim 1, wherein the length of said shorter leg portion (11; 25; 711; 1015) is in the order of about one-third the length of the longer leg portion (10, 25, 710, 1007).

12. The combination of claim 1, wherein said shorter leg portion (11, 26, 711, 1015) terminates in a cut end which is not deburred.

13. The combination of claim 1, wherein said intermediate holding portion includes a bent-over bowed or hook portion, said filament being hooked into said hook portion; and wherein said hook portion (15, 15*a*, 22) has a projecting hook region of sufficient dimension to ensure that the filament cannot come out of the hook.

14. The combination of claim 13, wherein said hook portion is formed by two converging frame regions, forming an acute angle with respect to each other.

15. The combination of claim 13, wherein the hook portion is engaged against the inner wall of the bulb in a region remote from a base end thereof.

16. The combination of claim 13, wherein said hook portion is bent away from a plane including the axis of the lamp.

17. The combination of claim 1, wherein the longer (10, 25, 710, 1007) leg portion is embedded in said pinch or press seal for a length of about $1 \pm 0.5$ mm.

18. The combination of claim 1, wherein the filament includes single-coiled end portions;

and wherein said lamp has current supply leads (12) which extend interiorly of the bulb for a short distance only and coupled to or being part of the end portions of the filament, the end portions of said filaments being devoid of core pins.

19. The combination of claim 2, wherein said shorter leg portion (11, 26, 711, 1015) terminates in a cut end which is not deburred.

20. A single-based lamp (1, 1001) having an essentially tubular bulb, a single pinch or press seal (5) formed at one end of the bulb;

an elongated filament within said bulb; and a lamp mount and holding frame (709) for said filament integrated into said tubular bulb, said holding frame comprising a unitary wire element devoid of a cross strap or cross bar, said frame having two leg portions (710, 711; 1007, 1015) and an intermediate holding portion (714, 714', 715; 1012, 1013) formed intermediate said leg portions and dimensioned and shaped to engage said filament and hold said filament in position within the bulb;

wherein one of said leg portions forms a shorter leg portion (11; 25; 711; 1015) which is substantially shorter than the other leg portion, said other leg portion forming a longer leg portion (10; 26; 710; 1007), said longer leg portion being melt-sealed in, and retained in said seal (5), at least part of said longer leg portion (10; 26; 710; 1007) extending parallel to the lamp axis, resiliently engaging against an inner wall surface of said bulb at a first region (1009) thereof, said shorter leg portion (11; 25; 711; 1015) resiliently engaging against the inner wall of the bulb at a region (712; 1009') opposite said first region and said longer leg portion, said shorter leg portion terminating intermediate the length of the bulb, whereby said longer leg portion and said shorter leg portion will be, with respect to longitudinal extent of the bulb, non-symmetrically positioned therein.

21. The lamp of claim 20, wherein said shorter leg portion (11, 26, 711, 1015) terminates in a cut end which is not deburred.

22. The lamp of claim 20, wherein said two leg portions include converging bent or bowed portions (714, 714'; **14*b*, 14*b*') adjacent said holding portion; and the holding portion is a hook-like element (15, 17; 715, 717; 22; 15*a*, 17*a***) into which said filament is hooked.

23. The lamp of claim 20, wherein said intermediate holding portion includes a U-shaped region (1013) in which the legs of the U face a base of the lamp;

and wherein said filament has an end portion (1021) which is wound around the legs of the U-shaped region of the intermediate portion (1013).

24. The lamp of claim 20, wherein two current supply means (**13; 13*a*, 13*b*) are provided, extending through said pinch or press seal (5); and wherein the longer (1007) leg portion is electrically connected to one of said current supply means (13*a*) and forms a filament current supply connection within the pinch or press seal (5) of the bulb (2**).

* * * * *